US009435289B2

(12) United States Patent
Shibata et al.

(10) Patent No.: US 9,435,289 B2
(45) Date of Patent: Sep. 6, 2016

(54) SYSTEMS AND METHODS FOR MINIMIZING THROUGHPUT

(71) Applicant: GM Global Technology Operations LLC, Detroit, MI (US)

(72) Inventors: Jonathan T. Shibata, Whitmore Lake, MI (US); Michael J. Lucido, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 211 days.

(21) Appl. No.: 14/242,001

(22) Filed: Apr. 1, 2014

(65) Prior Publication Data

US 2015/0275815 A1 Oct. 1, 2015

(51) Int. Cl.

| | |
|---|---|
| ***F02D 41/04*** | (2006.01) |
| ***F02D 41/34*** | (2006.01) |
| ***F02D 41/38*** | (2006.01) |
| ***F02M 51/06*** | (2006.01) |
| ***F02D 41/20*** | (2006.01) |

(52) U.S. Cl.

CPC ..... *F02D 41/3809* (2013.01); *F02D 41/20* (2013.01); *F02M 51/061* (2013.01); *F02D 41/04* (2013.01); *F02D 2041/2051* (2013.01)

(58) Field of Classification Search

CPC ..... F02D 41/402; F02D 41/3845; F02D 35/023; F02D 41/2467; F02D 41/0025; F02D 41/008; F02D 41/0087; F02D 41/345; F02D 41/3836; F02D 41/061; F02D 2041/1409; F02D 2041/1423; F02D 2041/1431; F02D 2041/1432; F02D 2041/2051; F02D 2041/2055; F02D 2041/2058

USPC ..... 701/101, 102, 103, 104, 105

See application file for complete search history.

(56) References Cited

U.S. PATENT DOCUMENTS

| | | | |
|---|---|---|---|
| 7,525,234 | B2 | 4/2009 | Martin |
| 7,715,950 | B2 | 5/2010 | Lasseter et al. |
| 9,074,552 | B2 | 7/2015 | Shibata et al. |
| 2005/0178360 | A1 | 8/2005 | Satou |
| 2007/0227506 | A1 | 10/2007 | Perryman et al. |

(Continued)

FOREIGN PATENT DOCUMENTS

| | | | | |
|---|---|---|---|---|
| GB | 201320692 | * | 1/2014 | ..... F02D 41/20 |
| LU | EP 2685074 A1 | * | 1/2014 | ..... F02D 41/3005 |

OTHER PUBLICATIONS

U.S. Appl. No. 14/231,807, filed Apr. 1, 2014, Lucido et al.

(Continued)

*Primary Examiner* — Hai Huynh
*Assistant Examiner* — Raza Njamuddin

(57) ABSTRACT

A voltage measuring module measures first and second voltages at first and second electrical connectors of a fuel injector of an engine. A first summer module determines a first sum of (i) a difference between the first and second voltages and (ii) N previous values of the difference between the first and second voltages, wherein N is an integer greater than or equal to one. A second summer module determines a second sum of (i) the first sum and (ii) M previous values of the first sum, wherein M is an integer greater than or equal to one. A first difference module determines a first difference based on the second sum. A second difference module determines a second difference between (i) the first difference and (ii) a previous value of the first difference. An injector driver module selectively applies power to the fuel injector based on the second difference.

21 Claims, 5 Drawing Sheets

(56) References Cited

U.S. PATENT DOCUMENTS

| | | | | |
|---|---|---|---|---|
| 2008/0129305 | A1 | 6/2008 | Perryman et al. | |
| 2011/0023836 | A1 | 2/2011 | Verner et al. | |
| 2013/0024098 | A1 | 1/2013 | Li et al. | |
| 2013/0054120 | A1 | 2/2013 | Yamada | |
| 2014/0000564 | A1* | 1/2014 | Shibata et al. | F02D 41/401 123/472 |
| 2015/0275807 | A1 | 10/2015 | Lucido et al. | |
| 2015/0275809 | A1 | 10/2015 | Shibata et al. | |
| 2015/0275815 | A1 | 10/2015 | Shibata et al. | |

OTHER PUBLICATIONS

U.S. Appl. No. 14/242,058, filed Apr. 1, 2014, Shibata et al.
U.S. Appl. No. 14/242,247, filed Apr. 1, 2014, Shibata et al.

* cited by examiner

SYSTEMS AND METHODS FOR MINIMIZING THROUGHPUT

CROSS-REFERENCE TO RELATED APPLICATIONS

This application is related to U.S. patent application Ser. No. 14/242,058 filed on Apr. 1, 2014, Ser. No. 14/242,247 filed on Apr. 1, 2014 and Ser. No. 14/231,807 filed on Apr. 1, 2014. The entire disclosure of the above applications are incorporated herein by reference.

FIELD

The present application relates to internal combustion engines and more particularly to fuel injector control systems and methods for engines.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs. The driver inputs may include, for example, accelerator pedal position, brake pedal position, and/or one or more other suitable driver inputs.

SUMMARY

In a feature, a fuel control system for a vehicle is disclosed. A voltage measuring module measures first and second voltages at first and second electrical connectors of a fuel injector of an engine. A first summer module determines a first sum of (i) a difference between the first and second voltages and (ii) N previous values of the difference between the first and second voltages, wherein N is an integer greater than or equal to one. A second summer module determines a second sum of (i) the first sum and (ii) M previous values of the first sum, wherein M is an integer greater than or equal to one. A first difference module determines a first difference based on the second sum. A second difference module determines a second difference between (i) the first difference and (ii) a previous value of the first difference. An injector driver module selectively applies power to the fuel injector based on the second difference.

In further features, a third difference module determines a third difference between (i) the second difference and (ii) a previous value of the second difference, and a fourth difference module determines a fourth difference between (i) the third difference and (ii) a previous value of the third difference. The injector driver module selectively applies power to the fuel injector based on the third difference and the fourth difference.

In still further features, a third summer module determines a third sum of (i) the second sum and (ii) O previous values of the second sum, wherein O is an integer greater than or equal to one, and the first difference module determines the first difference based on the third sum.

In yet further features, a fourth summer module determines a fourth sum of (i) the third sum and (ii) Q previous values of the third sum, wherein Q is an integer greater than or equal to one, and the first difference module determines the first difference based on the fourth sum.

In further features, a fifth summer module determines a fifth sum of (i) the fourth sum and (ii) R previous values of the fourth sum, wherein R is an integer greater than or equal to one, and the first difference module determines the first difference based on the fifth sum.

In still further features, the first difference module determines the first difference between (i) the fifth sum and (ii) a previous value of the fifth sum.

In yet further features, a parameter determination module determines a minimum value of the third difference and a maximum value of the third difference, and the injector driver module selectively applies power to the fuel injector based on the minimum and maximum values of the third difference.

In still further features, the parameter determination module determines the minimum value of the third difference based on a first zero-crossing of the fourth difference.

In yet further features, the parameter determination module determines the maximum value of the third difference based on a second zero-crossing of the fourth difference.

In still further features, a pulse width module determines an initial pulse width to apply to the fuel injector for a fuel injection event based on a target mass of fuel, an adjustment module adjusts initial pulse width based on the minimum and maximum values of the third difference to produce a final pulse width, and the injector driver module selectively applies power to the fuel injector for the fuel injection event based on the final pulse width.

In a feature, a control system for a vehicle includes: a voltage measuring module that measures first and second voltages at first and second electrical connectors of an actuator of the vehicle; a first summer module that determines a first sum of (i) a difference between the first and second voltages and (ii) N previous values of the difference between the first and second voltages, wherein N is an integer greater than or equal to one; a second summer module that determines a second sum of (i) the first sum and (ii) M previous values of the first sum, wherein M is an integer greater than or equal to one; a first difference module that determines a first difference based on the second sum; a second difference module that determines a second difference between (i) the first difference and (ii) a previous value of the first difference; and a driver module that selectively applies power to the actuator based on the second difference.

In yet another feature, a fuel control method for a vehicle includes: measuring first and second voltages at first and second electrical connectors of a fuel injector of an engine; determining a first sum of (i) a difference between the first and second voltages and (ii) N previous values of the difference between the first and second voltages, wherein N is an integer greater than or equal to one; determining a second sum of (i) the first sum and (ii) M previous values of the first sum, wherein M is an integer greater than or equal to one; determining a first difference based on the second sum; determining a second difference between (i) the first difference and (ii) a previous value of the first difference; and selectively applying power to the fuel injector based on the second difference.

In further features, the fuel control method further includes: determining a third difference between (i) the second difference and (ii) a previous value of the second difference; determining a fourth difference between (i) the third difference and (ii) a previous value of the third difference; and selectively applying power to the fuel injector based on the third difference and the fourth difference.

In still further features, the fuel control method further includes: determining a third sum of (i) the second sum and (ii) O previous values of the second sum, wherein O is an integer greater than or equal to one; and determining the first difference based on the third sum.

In yet further features, the fuel control method further includes: determining a fourth sum of (i) the third sum and (ii) Q previous values of the third sum, wherein Q is an integer greater than or equal to one; and determining the first difference based on the fourth sum.

In further features, the fuel control method further includes: determining a fifth sum of (i) the fourth sum and (ii) R previous values of the fourth sum, wherein R is an integer greater than or equal to one; and determining the first difference based on the fifth sum.

In still further features, the fuel control method further includes determining the first difference between (i) the fifth sum and (ii) a previous value of the fifth sum.

In yet further features, the fuel control method further includes: determining a minimum value of the third difference and a maximum value of the third difference; and selectively applying power to the fuel injector based on the minimum and maximum values of the third difference.

In further features, the fuel control method further includes determining the minimum value of the third difference based on a first zero-crossing of the fourth difference.

In still further features, the fuel control method further includes determining the maximum value of the third difference based on a second zero-crossing of the fourth difference.

In yet further features, the fuel control method further includes: determining an initial pulse width to apply to the fuel injector for a fuel injection event based on a target mass of fuel; adjusting initial pulse width based on the minimum and maximum values of the third difference to produce a final pulse width; and selectively applying power to the fuel injector for the fuel injection event based on the final pulse width.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel within cylinders to generate drive torque. A throttle valve regulates airflow into the engine. Fuel is injected by fuel injectors. Spark plugs may generate spark within the cylinders to initiate combustion. Intake and exhaust valves of a cylinder may be controlled to regulate flow into and out of the cylinder.

The fuel injectors receive fuel from a fuel rail. A high pressure fuel pump receives fuel from a low pressure fuel pump and pressurizes the fuel within the fuel rail. The low pressure fuel pump draws fuel from a fuel tank and provides fuel to the high pressure fuel pump. The fuel injectors inject fuel directly into the cylinders of the engine.

Different fuel injectors, however, may have different opening and closing characteristics. For example, fuel injectors from different fuel injector manufacturers may have different opening and closing characteristics. Even fuel injectors from the same fuel injector manufacturer, however, may have different opening and closing characteristics. Example opening and closing characteristics include, for example, opening period and closing period. The opening period of a fuel injector may refer to the period between a first time when power is applied to the fuel injector to open the fuel injector and a second time when the fuel injector actually opens in response to the application of power. The closing period of a fuel injector may refer to the period between a first time when power is removed from the fuel injector to close the fuel injector and a second time when the fuel injector reaches a fully closed state in response to the removal of power.

The present application involves determining various parameters based on a difference between voltages at first and second electrical conductors of a fuel injector. More specifically, parameters that track second, third, and fourth (order) derivatives of the difference are determined using a plurality of sums and differences. An engine control module (ECM) determines characteristics of the fuel injector based on these parameters. The ECM controls application of power to the fuel injector based on the characteristics of the fuel injector.

Figure 1:
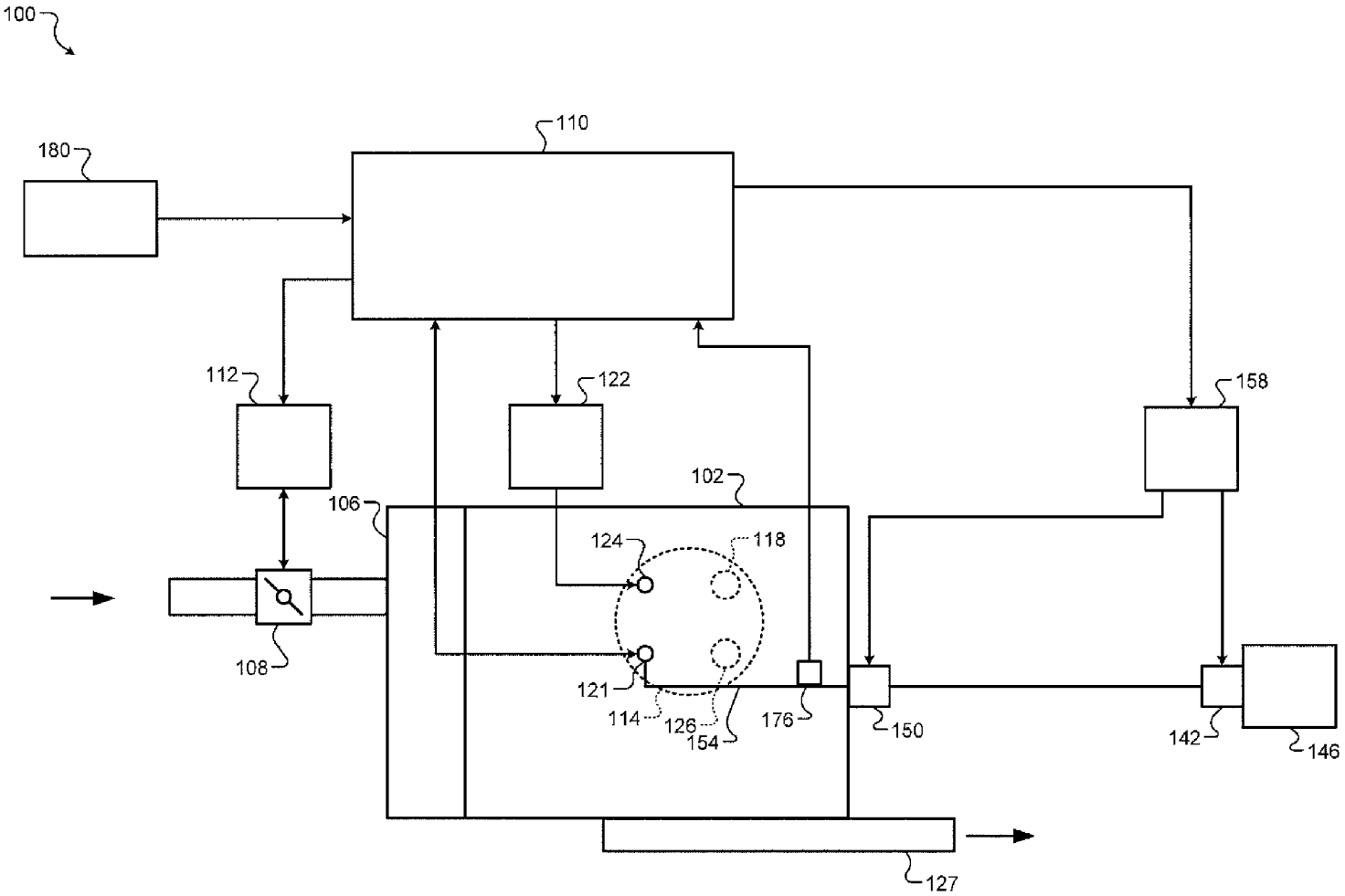
FIG. 1 is a functional block diagram of an example direct injection engine system.

Referring now to FIG. 1, a functional block diagram of an example engine system 100 for a vehicle is presented. The engine system 100 includes an engine 102 that combusts an air/fuel mixture to produce drive torque for a vehicle. While the engine 102 will be discussed as a spark ignition direct injection (SIDI) engine, the engine 102 may include another type of engine. One or more electric motors and/or motor generator units (MGUs) may be provided with the engine 102.

Air is drawn into an intake manifold 106 through a throttle valve 108. The throttle valve 108 may vary airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through an intake valve 118. One or more intake valves may be provided with each cylinder.

The ECM 110 controls fuel injection into the cylinder 114 via a fuel injector 121. The fuel injector 121 injects fuel, such as gasoline, directly into the cylinder 114. The fuel injector 121 is a solenoid type, direct injection fuel injector. Solenoid type, direct injection fuel injectors are different than port fuel injection (PFI) injectors and piezo electric fuel injectors. The ECM 110 may control fuel injection to achieve a desired air/fuel ratio, such as a stoichiometric air/fuel ratio. A fuel injector may be provided for each cylinder.

The injected fuel mixes with air and creates an air/fuel mixture in the cylinder 114. Based upon a signal from the ECM 110, a spark actuator module 122 may energize a spark plug 124 in the cylinder 114. A spark plug may be provided for each cylinder. Spark generated by the spark plug 124 ignites the air/fuel mixture.

The engine 102 may operate using a four-stroke cycle or another suitable operating cycle. The four strokes, described below, may be referred to as the intake stroke, the compression stroke, the combustion stroke, and the exhaust stroke. During each revolution of a crankshaft (not shown), two of the four strokes occur within the cylinder 114. Therefore, two crankshaft revolutions are necessary for the cylinders to experience all four of the strokes.

During the intake stroke, air from the intake manifold 106 is drawn into the cylinder 114 through the intake valve 118. Fuel injected by the fuel injector 121 mixes with air and creates an air/fuel mixture in the cylinder 114. One or more fuel injections may be performed during a combustion cycle. During the compression stroke, a piston (not shown) within the cylinder 114 compresses the air/fuel mixture. During the combustion stroke, combustion of the air/fuel mixture drives the piston, thereby driving the crankshaft. During the exhaust stroke, the byproducts of combustion are expelled through an exhaust valve 126 to an exhaust system 127.

A low pressure fuel pump 142 draws fuel from a fuel tank 146 and provides fuel at low pressures to a high pressure fuel pump 150. While only the fuel tank 146 is shown, more than one fuel tank 146 may be implemented. The high pressure fuel pump 150 further pressurizes the fuel within a fuel rail 154. The fuel injectors of the engine 102, including the fuel injector 121, receive fuel via the fuel rail 154. Low pressures provided by the low pressure fuel pump 142 are described relative to high pressures provided by the high pressure fuel pump 150.

The low pressure fuel pump 142 may be an electrically driven pump. The high pressure fuel pump 150 may be a variable output pump that is mechanically driven by the engine 102. A pump actuator module 158 may control output of the high pressure fuel pump 150 based on signals from the ECM 110. The pump actuator module 158 may also control operation (e.g., ON/OFF state) of the low pressure fuel pump 142.

The engine system 100 includes a fuel pressure sensor 176. The fuel pressure sensor 176 measures a pressure of the fuel in the fuel rail 154. The engine system 100 may include one or more other sensors 180. For example, the other sensors 180 may include one or more other fuel pressure sensors, a mass air flowrate (MAF) sensor, a manifold absolute pressure (MAP) sensor, an intake air temperature (IAT) sensor, a coolant temperature sensor, an oil temperature sensor, a crankshaft position sensor, and/or one or more other suitable sensors.

Figure 2:
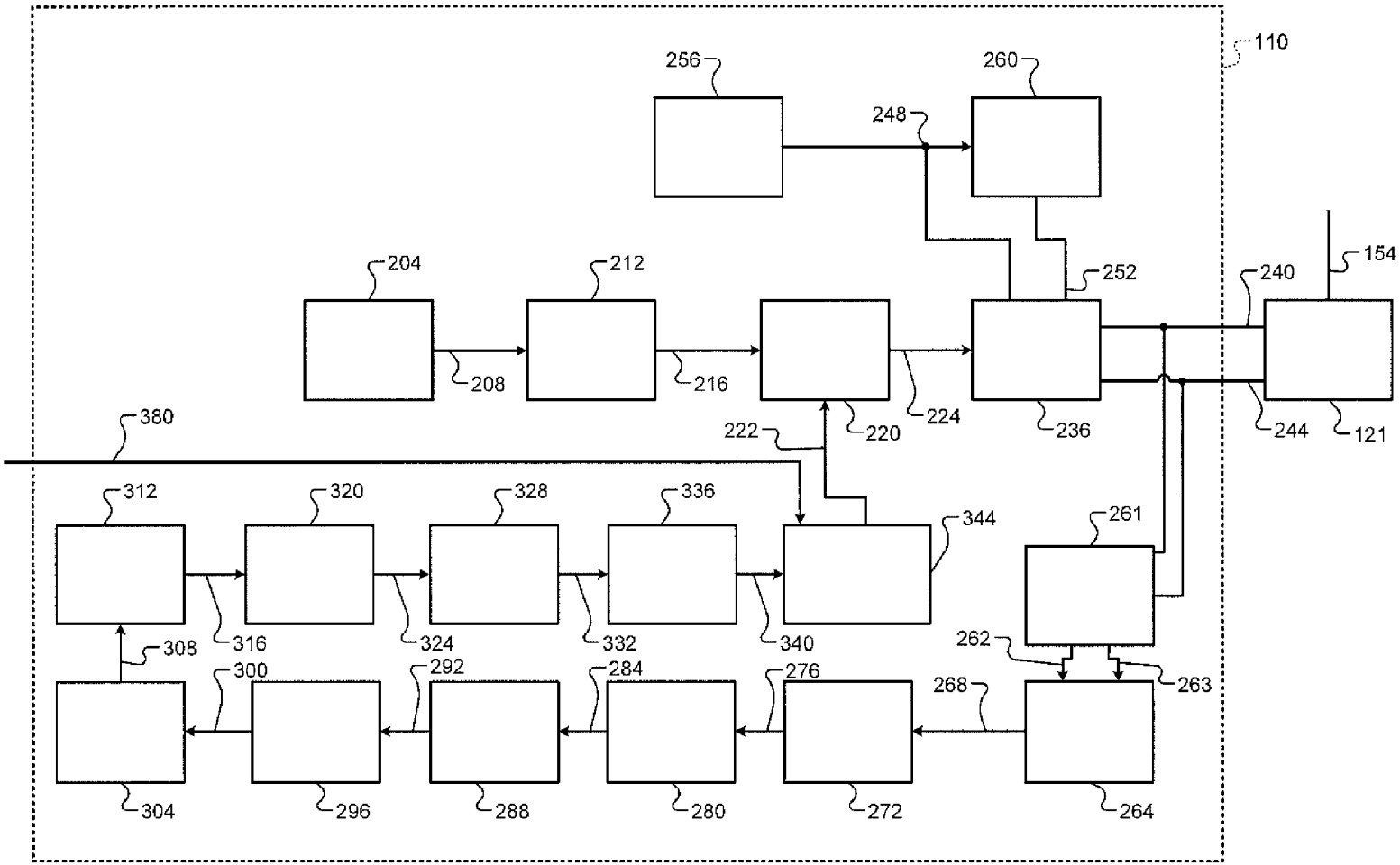
FIG. 2 is a functional block diagram of an example fuel control system including a portion of an engine control module.

Referring now to FIG. 2, a functional block diagram of an example fuel control system including an example portion of the ECM 110 is presented. A fueling module 204 determines target fuel injection parameters 208 for a fuel injection event of the fuel injector 121. For example, the fueling module 204 may determine a target mass of fuel for the fuel injection event and a target starting timing for the fuel injection event. The fueling module 204 may determine the target mass of fuel, for example, based on a target air/fuel ratio (e.g., stoichiometry) and an expected mass of air within the cylinder 114 for the fuel injection event. One or more fuel injection events may be performed during a combustion cycle of the cylinder 114.

A pulse width module 212 determines an initial (fuel injection) pulse width 216 for the fuel injection event based on the target mass of fuel. The pulse width module 212 may determine the initial pulse width 216 further based on pressure of the fuel within the fuel rail 154 and/or one or more other parameters. The initial pulse width 216 corresponds to a period to apply power to the fuel injector 121 during the fuel injection event to cause the fuel injector 121 to inject the target mass of fuel under the operating conditions.

Different fuel injectors, however, may have different closing periods, opening periods, opening magnitudes, and other characteristics. The closing period of a fuel injector may refer to the period between: a first time when power is removed from the fuel injector to close the fuel injector; and a second time when the fuel injector actually becomes closed and stops injecting fuel. Fuel injectors with longer closing periods will inject more fuel than fuel injectors with shorter closing periods despite all of the fuel injectors being controlled to inject the same amount of fuel.

The opening period of a fuel injector may refer to the period between: a first time when power is applied to the fuel injector to open the fuel injector; and a second time when the fuel injector actually becomes open and begins injecting fuel. Fuel injectors with longer opening periods will inject less fuel than fuel injectors with shorter opening periods despite all of the fuel injectors being controlled to inject the same amount of fuel. The opening magnitude of a fuel injector may correspond to how much the fuel injector opens for a fuel injection event.

An adjusting module 220 adjusts the initial pulse width 216 based on one or more injector parameters 222 determined for the fuel injector 121 to produce a final pulse width 224. The adjustment of the initial pulse width 216 may include lengthening or shortening the initial pulse width 216 to determine the final pulse width 224, such as by advancing or retarding a beginning of the pulse and/or advancing or retarding an ending of the pulse. Determination of the final pulse width 224 and the injector parameters 222 is described in detail below.

An injector driver module 236 determines a target current profile (not shown) based on the final pulse width 224. The injector driver module 236 applies high and low voltages to first and second electrical connectors of the fuel injector 121 via high and low side lines 240 and 244 to achieve the target current profile through the fuel injector 121 for the fuel injection event.

The injector driver module 236 may generate the high and low voltages using reference and boost voltages 248 and 252. The reference and boost voltages 248 and 252 may be direct current (DC) voltages. A reference voltage module 256 provides the reference voltage 248, for example, based on a voltage of a battery (not shown) of the vehicle. A DC/DC converter module 260 boosts (increases) the reference voltage 248 to generate the boost voltage 252.

A voltage measuring module 261 measures the high voltage at the first electrical connector of the fuel injector 121 and generates a high side voltage 262 based on the voltage at the first electrical conductor. The voltage measuring module 261 also measures the low voltage at the second electrical connector of the fuel injector 121 and generates a low side voltage 263 based on the voltage at the second electrical conductor. The voltage measuring module 261 measures the high and low voltages relative to a ground reference potential.

A voltage difference module 264 generates a voltage difference 268 based on a difference between the low side voltage 263 and the high side voltage 262. For example, the voltage difference module 264 may set the voltage difference 268 equal to the low side voltage 263 minus the high side voltage 262. For another example, the voltage difference module 264 may set the voltage difference 268 equal to the high side voltage 262 minus the low side voltage 263. The voltage difference module 264 samples the low side voltage 263 and the high side voltage 262 and generates values of the voltage difference 268 based on a predetermined sampling rate. A filter, such as a low pass filter (LPF) or another suitable type of filter, may be implemented to filter the voltage difference 268. An analog to digital converter (ADC) may also be implemented such that the voltage difference 268 includes corresponding digital values.

A first summer module 272 determines a first sum 276 by summing the last N values of the voltage difference 268. N is an integer greater than one. For example only, N may be 8 or another suitable value. The first summer module 272 updates the first sum 276 every N sampling periods such that the first sum 276 is updated each time that N new values of the voltage difference 268 have been received.

A second summer module 280 determines a second sum 284 by summing the last M values of the first sum 276. M is an integer greater than one. For example only, M may be 10 or another suitable value. The second summer module 280 updates the second sum 284 each time the first sum 276 is updated.

A third summer module 288 determines a third sum 292 by summing the last M values of the second sum 284. The third summer module 288 updates the third sum 292 each time the second sum 284 is updated. A fourth summer module 296 determines a fourth sum 300 by summing the last M values of the third sum 292. The fourth summer module 296 updates the fourth sum 300 each time the third sum 292 is updated. A fifth summer module 304 determines a fifth sum 308 by summing the last M values of the fourth sum 300. The fifth summer module 304 updates the fifth sum 308 each time the fourth sum 300 is updated. While the example of calculating the first-fifth sums 276, 284, 292, 300, and 308 is shown and discussed, two or more sums may be determined, and a greater or lesser number of summer modules may be implemented. The first summer module 272 reduces sampling errors and jitter and also reduces the number of later computations necessary. The other summer modules provide shape preserving filters. Also, while the second-fifth summer modules are each discussed as using M values, one or more of the second-fifth summer modules may use a different number of previous values.

A first difference module 312 determines a first difference 316 based on a difference between the fifth sum 308 and a previous (e.g., last) value of the fifth sum 308. A second difference module 320 determines a second difference 324 based on a difference between the first difference 316 and a previous (e.g., last) value of the first difference 316.

A third difference module 328 determines a third difference 332 based on a difference between the second difference 324 and a previous (e.g., last) value of the second difference 324. A fourth difference module 336 determines a fourth difference 340 based on a difference between the third difference 332 and a previous (e.g., last) value of the third difference 332.

The first difference 316 corresponds to and has the same shape as a first derivative (d/dt) of the voltage difference 268. The second difference 324 corresponds to and has the same shape as a second derivative ($d^2/dt^2$) of the voltage difference 268. The third difference 332 corresponds to and has the same shape as a third derivative ($d^3/dt^3$) of the voltage difference 268. The fourth difference 340 corresponds to and has the same shape as a fourth derivative ($d^4/dt^4$) of the voltage difference 268.

Additionally, minimum and maximum values of the first difference 316 occur at the same times as minimum and maximum values of the first derivative (d/dt) of the voltage difference 268. Minimum and maximum values of the second difference 324 also occur at the same times as minimum and maximum values of the second derivative ($d^2/dt^2$) of the voltage difference 268. Minimum and maximum values of the third difference 332 also occur at the same times as minimum and maximum values of the ($d^3/dt^3$) of the voltage difference 268. However, calculation of first-fourth derivatives is less computationally efficient than calculating the first-fourth differences 316, 324, 332, and 340, as discussed above. Since the first-fourth differences 316, 324, 332, and 340 are determined at a predetermined rate, the first-fourth differences 316, 324, 332, and 340 are an accurate representative of the first-fourth derivatives. Additionally, using sums instead of averages reduces computational complexity and maintains the shape of the input signal.

While the example of calculating the first-fourth differences 316, 324, 332, and 340 has been discussed, two or more differences may be determined, and a greater or lesser number of difference modules may be implemented. Also, while the example is discussed in terms of use of the voltage difference 268, the present application is applicable to identifying changes in other signals.

A parameter determination module 344 determines the injector parameters 222 for the fuel injector 121 based on the voltage difference 268 and the third and fourth differences 332 and 340. The parameter determination module 344 may determine the injector parameters 222 additionally or alternatively based on one or more other parameters.

Figure 3:
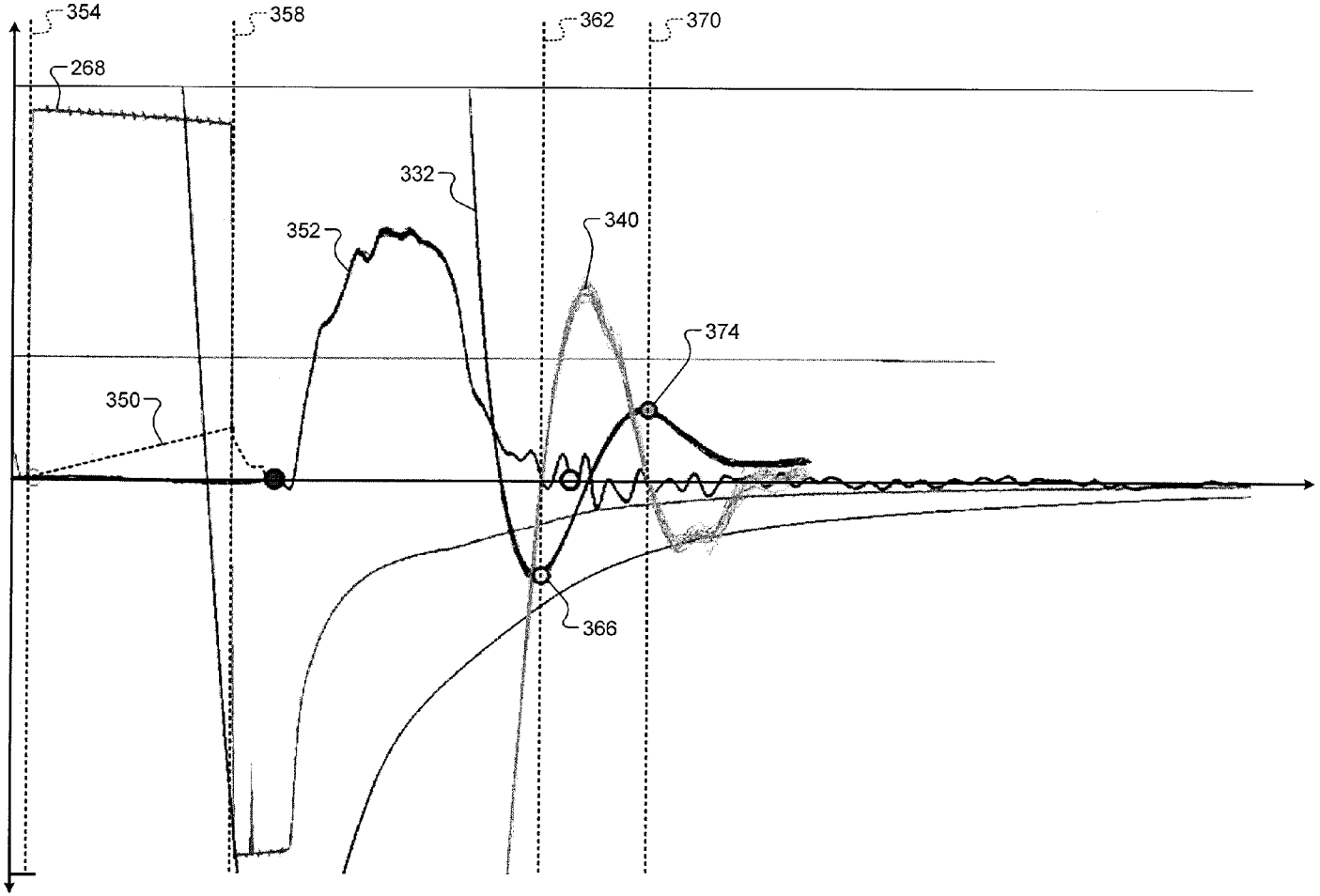
FIG. 3 is an example graph of voltage and current of a fuel injector, and various parameters determined based on the voltage for an injection event.

FIG. 3 includes a graph including example traces of the voltage difference 268, current 350 through the fuel injector 121, the third difference 332, the fourth difference 340 and fuel flow 352 versus time for a fuel injection event. Referring now to FIGS. 2 and 3, the injector driver module 236 applies a pulse to the fuel injector 121 from time 354 until time 358 for the fuel injection event. Current flows through the fuel injector 121 based on the application of the pulse to the fuel injector 121, as illustrated by 350.

The period between when the injector driver module 236 ends the pulse and when the fuel injector 121 reaches a fully closed state may be referred to as the closing period of the fuel injector 121. A first zero crossing of the fourth difference 340 that occurs after the injector driver module 236 ends the pulse may correspond to the time when the fuel injector 121 reaches the fully closed state. In FIG. 3, the fourth difference 340 first crosses zero at approximately time 362. The closing period of the fuel injector 121 therefore corresponds to the period between time 358 and time 362 in FIG. 3. The parameter determination module 344 determines the closing period of the fuel injector 121 based on the period between the time that the injector driver module 236 ends the pulse for a fuel injection event and the time that the fourth difference 340 first crosses zero after the end of the pulse.

The third difference 332 reaches a minimum value at the first zero crossing of the fourth difference 340. The minimum value of the third difference 332 is indicated by 366 in FIG. 3. The third difference 332 reaches a maximum value at a second zero crossing of the fourth difference 340 that occurs after the injector driver module 236 ends the pulse. In FIG. 3, the second zero crossing of the fourth difference 340 occurs at approximately time 370, and the maximum value of the third difference 332 is indicated by 374.

In various implementations, a first predetermined offset may be applied to the first zero crossing to identify the minimum value of the third difference 332 and/or a second predetermined offset may be applied to the second zero crossing to identify the maximum value of the third difference 332. For example, the minimum value of the third difference 332 may occur the first predetermined offset before or after the first zero crossing of the fourth difference 340 and/or the maximum value of the third difference 332 may occur the second predetermined offset before or after the second zero crossing of the fourth difference 340. The application of the first and/or second predetermined offsets may be performed to better correlate with the minimum and maximum values of the third difference 332.

The parameter determination module 344 determines an opening magnitude of the fuel injector 121 based on a difference between the minimum value 366 of the third difference 332 and the maximum value 374 of the third difference 332.

Based on the closing period of the fuel injector 121 and the opening magnitude of the fuel injector 121, the length of pulses applied to the fuel injector 121 can be adjusted such that the fuel injector 121 will as closely as possible inject the same amount of fuel as other fuel injectors, despite manufacturing differences between the fuel injectors. Adjustments are determined and applied for each fuel injector. Without the adjustments, the differences between the fuel injectors may cause the fuel injectors to inject different amounts of fuel.

The parameter determination module 344 may determine a closing period delta for the fuel injector 121 based on a difference between the closing period of the fuel injector 121 and a predetermined closing period. The predetermined closing period may be calibrated based on the closing periods of a plurality of fuel injectors. For example only, the parameter determination module 344 may set the closing period delta based on or equal to the predetermined closing period minus the closing period of the fuel injector 121.

The parameter determination module 344 may determine a closing period compensation value based on the closing period delta and a closing period adjustment value. For example only, the parameter determination module 344 may set the closing period compensation value based on or equal to a product of the closing period delta and the closing period adjustment value. The parameter determination module 344 may determine the closing period adjustment value based on the final pulse width 224 used for a fuel injection event and a fuel pressure 380 of the fuel injection event. The parameter determination module 344 may determine the closing period adjustment value, for example, using one of a function and a mapping that relates the final pulse width 224 and the fuel pressure 380 to the closing period adjustment value. The fuel pressure 380 corresponds to a pressure of the fuel provided to the fuel injector 121 for the fuel injection event and may be, for example, measured using the fuel pressure sensor 176.

The parameter determination module 344 may determine an opening period adjustment value for the fuel injector 121 based on the final pulse width 224 used for a fuel injection event and a predetermined pulse width for the fuel injection event. For example only, the parameter determination module 344 may set the opening period adjustment value based on a difference between the final pulse width 224 for the fuel injection event and the predetermined pulse width for the fuel injection event. The parameter determination module 344 may, for example, set the opening period adjustment value based on or equal to the final pulse width 224 for the fuel injection event minus the predetermined pulse width for the fuel injection event.

The parameter determination module 344 may determine the predetermined pulse width for the fuel injection event based on the opening magnitude of the fuel injector 121 and the fuel pressure 380 for the fuel injection event. Determination of the opening magnitude of the fuel injector 121 is discussed above. The parameter determination module 344 may determine the predetermined pulse width, for example, using one of a function and a mapping that relates the opening magnitude and the fuel pressure 380 to the predetermined pulse width.

As stated above, the adjusting module 220 adjusts the initial pulse width 216 for a fuel injection event based on one or more of the injector parameters 222 to determine the final pulse width 224 for the fuel injection event. For example only, the adjusting module 220 may set the final pulse width 224 based on the initial pulse width 216, the opening period compensation value, and the closing period compensation value. The adjusting module 220 may set the final pulse width 224, for example, using one of a function and a mapping that relates the initial pulse width 216, the opening period compensation value, and the closing period compensation value to the final pulse width 224. For example only, the adjusting module 220 may set the final pulse width 224 equal to or based on a sum of the initial pulse width 216, the opening period compensation value, and the closing period compensation value. While the above example is discussed in terms of the fuel injector 121, a respective opening period compensation value and a respective closing period compensation value may be determined and used for each fuel injector.

Figure 4:
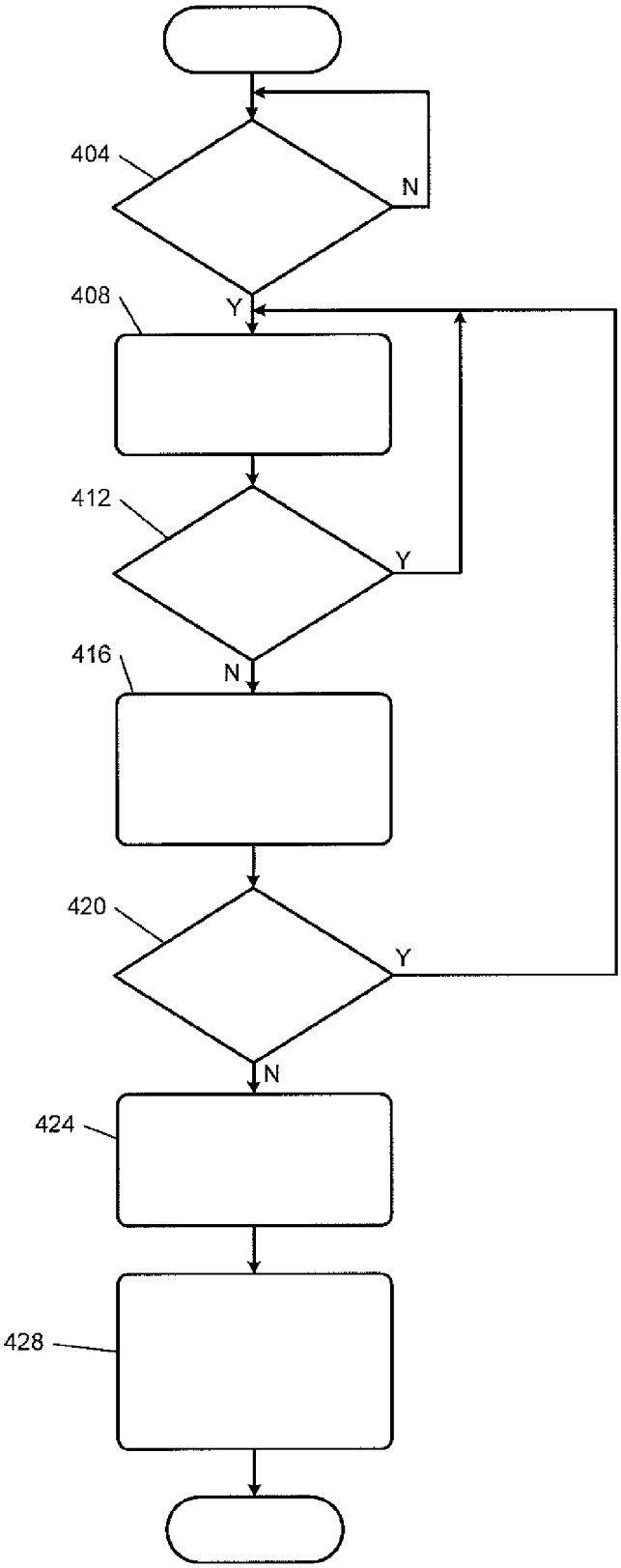
FIG. 4 is a flowchart depicting an example method of determining various parameters for a fuel injection event of a fuel injector.

FIG. 4 is a flowchart depicting an example method of determining the first-fifth sums 276, 284, 292, 300, and 308 and the first-fourth differences 316, 324, 332, and 340 for determining the closing period, the closing period compensation value, and the opening period compensation value for a fuel injection event of the fuel injector 121. Control may begin with 404 where the parameter determination module 344 determines whether the injector driver module 236 has stopped applying a pulse to the fuel injector 121 for the fuel injection event. If 404 is true, the parameter determination module 344 may start a timer, and control continues with 408. If 404 is false, control may remain at 404.

At 408, the voltage difference module 264 samples the high and low side voltages 262 and 263 and generates a value of the voltage difference 268 based on the samples. The parameter determination module 344 may also reset a sample counter value at 408. At 412, the parameter determination module 344 determines whether the sample counter value is less than N. As described above, N is the number of values used by the first summer module 272 to determine the first sum 276. If 412 is true, control may return to 408. If 412 is false, control continues with 416.

At 416, the first summer module 272 determines the first sum 276 based on the last N values of the voltage difference 268. The second summer module 280 determines the second sum 284 based on the last M values of the first sum 276. The third summer module 288 determines the third sum 292 based on the last M values of the second sum 284. The fourth summer module 296 determines the fourth sum 300 based on the last M values of the third sum 292. The fifth summer module 304 determines the fifth sum 308 based on the last M values of the fourth sum 300.

Also at 416, the first difference module 312 determines the first difference 316 between the fifth sum 308 and the last value of the fifth sum 308. The second difference module 320 determines the second difference 324 between the first difference 316 and the last value of the first difference 316. The third difference module 328 determines the third difference 332 between the second difference 324 and the last value of the second difference 324. The fourth difference module 336 determines the fourth difference 340 between the third difference 332 and the last value of the third difference 332. The parameter determination module 344 also increments an update counter value and resets the sample counter value at 416.

At 420, the parameter determination module 344 determines whether the update counter value is less than a predetermined value. If 420 is true, control returns to 408. If 420 is false, control continues with 424. The predetermined value is calibratable and is set based on the number of samples of the voltage difference 268 necessary to fill all of the following modules with new values: the first summer module 272, the second summer module 280, the third summer module 288, the fourth summer module 296, the fifth summer module 304, the first difference module 312, the second difference module 320, the third difference module 328, and the fourth difference module 336. For example only, based on the example of FIG. 2, the predetermined value may be set to greater than or equal to:

$$(N*M)+Q(N*(M-1))+N*R,$$

where N is the number of samples used by the first summer module 272, M is the number of samples used by the second, third, fourth, and fifth summer modules 280, 288, 296, and 304 (in the example where the same number of samples are used), Q is the number of summer modules implemented that update their outputs each time the first summer module 272 updates the first sum 276, and R is the number of difference modules implemented. In the example of FIG. 2, Q equals 4 (for the second, third, fourth, and fifth summer modules 280, 288, 296, and 304), and R equals 4 (for the first, second, third, and fourth difference modules 312, 320, 328, and 336).

At 424, the parameter determination module 344 may monitor the fourth difference 340 for the first zero crossing. The parameter determination module 344 may identify the minimum value of the third difference 332 as the value of the third difference 332 occurring at the first zero crossing of the fourth difference 340. The parameter determination module 344 may also monitor the fourth difference for the second zero crossing. The parameter determination module 344 may identify the maximum value of the third difference 332 as the value of the third difference 332 occurring at the second zero crossing of the fourth difference 340. While not explicitly shown, control continues to generate samples of the voltage difference 268 and to update the first, second, third, fourth, and fifth sums 276, 284, 292, 300, and 308 and the first, second, third, and fourth differences 316, 324, 332, and 340 at 424 to determine the minimum and maximum values of the third difference 332.

The parameter determination module 344 may determine closing period of the fuel injector 121 at 428. The parameter determination module 344 may determine the closing period of the fuel injector 121 based on the timer value at the first zero crossing of the fourth difference 340.

The parameter determination module 344 may also determine the opening period compensation value and the closing period compensation value for the fuel injector 121 at 428. The parameter determination module 344 determines the opening magnitude of the fuel injector 121 based on a difference between the minimum value of the third difference 332 and the maximum value of the third difference 332. The parameter determination module 344 may determine the closing period delta for the fuel injector 121 based on a difference between the closing period of the fuel injector 121 and the predetermined closing period. For example only, the parameter determination module 344 may set the closing period delta based on or equal to the predetermined closing period minus the closing period of the fuel injector 121.

The parameter determination module 344 may determine the closing period compensation value based on the closing period delta and a closing period adjustment value. For example only, the parameter determination module 344 may set the closing period compensation value based on or equal to a product of the closing period delta and the closing period adjustment value. The parameter determination module 344 may determine the closing period adjustment value for the fuel injection event based on the final pulse width 224 used for a fuel injection event and the fuel pressure 380 for the fuel injection event. The parameter determination module 344 may determine the closing period adjustment value, for example, using one of a function and a mapping that relates the final pulse width 224 and the fuel pressure 380 to the closing period adjustment value.

The parameter determination module 344 may determine the opening period adjustment value for the fuel injector 121 based on the final pulse width 224 used for the fuel injection event and the predetermined pulse width for the fuel injection event. For example only, the parameter determination module 344 may set the opening period adjustment value based on a difference between the final pulse width 224 for the fuel injection event and the predetermined pulse width for the fuel injection event. The parameter determination module 344 may, for example, set the opening period adjustment value based on or equal to the final pulse width 224 for the fuel injection event minus the predetermined pulse width for the fuel injection event.

The parameter determination module 344 may determine the predetermined pulse width for the fuel injection event based on the opening magnitude of the fuel injector 121 and the fuel pressure 380 for the fuel injection event. The parameter determination module 344 may determine the predetermined pulse width, for example, using one of a function and a mapping that relates the opening magnitude and the fuel pressure 380 to the opening period adjustment value.

As stated above, the closing period compensation value and the opening period compensation value can be used to adjust the initial pulse width 216 determined for future fuel injection events.

Figure 5:
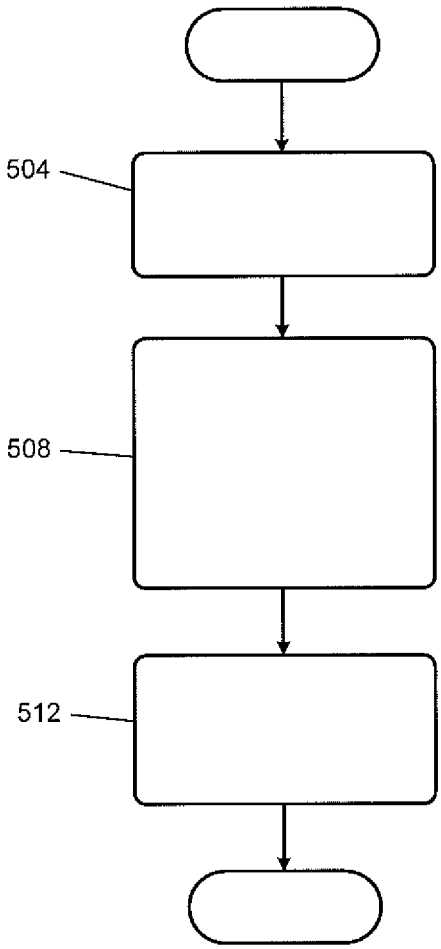
FIG. 5 is a flowchart depicting an example method of controlling fueling for a fuel injection event of the fuel injector.

FIG. 5 is a flowchart depicting an example method of controlling fueling for a fuel injection event of the fuel injector 121. Control may begin with 504 where the pulse width module 212 determines the initial pulse width 216 for a fuel injection event of the fuel injector 121. The pulse width module 212 may determine the initial pulse width 216 based on the target mass determined for the fuel injection event, which may be determined based on a target air/fuel mixture and a mass of air expected to be within the cylinder 114.

At 508, the adjusting module 220 adjusts the initial pulse width 216 based on the opening period compensation value and the closing period compensation value to produce the final pulse width 224. For example, the adjusting module 220 may set the final pulse width 224 equal to or based on a sum of the initial pulse width 216, the opening period compensation value, and the closing period compensation value. At 512, the injector driver module 236 applies power to the fuel injector 121 based on the final pulse width 224. The application of power to the fuel injector 121 should cause the fuel injector 121 to open and inject fuel for the fuel injection event.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A fuel control system for a vehicle, comprising:

a voltage measuring module that measures first and second voltages at first and second electrical connectors of a fuel injector of an engine;

a first summer module that determines a first sum of (i) a difference between the first and second voltages and (ii) N previous values of the difference between the first and second voltages, wherein N is an integer greater than or equal to one;

a second summer module that determines a second sum of (i) the first sum and (ii) M previous values of the first sum, wherein M is an integer greater than or equal to one;

a first difference module that determines a first difference based on the second sum;

a second difference module that determines a second difference between (i) the first difference and (ii) a previous value of the first difference; and an injector driver module that selectively applies power to the fuel injector based on the second difference.

2. The fuel control system of claim 1 further comprising:

a third difference module that determines a third difference between (i) the second difference and (ii) a previous value of the second difference; and a fourth difference module that determines a fourth difference between (i) the third difference and (ii) a previous value of the third difference, wherein the injector driver module selectively applies power to the fuel injector based on the third difference and the fourth difference.

3. The fuel control system of claim 2 further comprising:

a third summer module that determines a third sum of (i) the second sum and (ii) O previous values of the second sum, wherein O is an integer greater than or equal to one, wherein the first difference module determines the first difference based on the third sum.

4. The fuel control system of claim 3 further comprising:

a fourth summer module that determines a fourth sum of (i) the third sum and (ii) Q previous values of the third sum, wherein Q is an integer greater than or equal to one, wherein the first difference module determines the first difference based on the fourth sum.

5. The fuel control system of claim 4 further comprising:

a fifth summer module that determines a fifth sum of (i) the fourth sum and (ii) R previous values of the fourth sum, wherein R is an integer greater than or equal to one, wherein the first difference module determines the first difference based on the fifth sum.

6. The fuel control system of claim 5 wherein the first difference module determines the first difference between (i) the fifth sum and (ii) a previous value of the fifth sum.

7. The fuel control system of claim 2 further comprising a parameter determination module that determines a minimum value of the third difference and a maximum value of the third difference, wherein the injector driver module selectively applies power to the fuel injector based on the minimum and maximum values of the third difference.

8. The fuel control system of claim 7 wherein the parameter determination module determines the minimum value of the third difference based on a first zero-crossing of the fourth difference.

9. The fuel control system of claim 8 wherein the parameter determination module determines the maximum value of the third difference based on a second zero-crossing of the fourth difference.

10. The fuel control system of claim 7 further comprising:

a pulse width module that determines an initial pulse width to apply to the fuel injector for a fuel injection event based on a target mass of fuel; and an adjustment module that adjusts initial pulse width based on the minimum and maximum values of the third difference to produce a final pulse width, wherein the injector driver module selectively applies power to the fuel injector for the fuel injection event based on the final pulse width.

11. A control system for a vehicle, comprising:

a voltage measuring module that measures first and second voltages at first and second electrical connectors of an actuator of the vehicle;

a first summer module that determines a first sum of (i) a difference between the first and second voltages and (ii) N previous values of the difference between the first and second voltages, wherein N is an integer greater than or equal to one;

a second summer module that determines a second sum of (i) the first sum and (ii) M previous values of the first sum, wherein M is an integer greater than or equal to one;

a first difference module that determines a first difference based on the second sum;

a second difference module that determines a second difference between (i) the first difference and (ii) a previous value of the first difference; and a driver module that selectively applies power to the actuator based on the second difference.

12. A fuel control method for a vehicle, comprising:

measuring first and second voltages at first and second electrical connectors of a fuel injector of an engine;

determining a first sum of (i) a difference between the first and second voltages and (ii) N previous values of the difference between the first and second voltages, wherein N is an integer greater than or equal to one;

determining a second sum of (i) the first sum and (ii) M previous values of the first sum, wherein M is an integer greater than or equal to one;

determining a first difference based on the second sum;

determining a second difference between (i) the first difference and (ii) a previous value of the first difference; and selectively applying power to the fuel injector based on the second difference.

13. The fuel control method of claim 12 further comprising:

determining a third difference between (i) the second difference and (ii) a previous value of the second difference;

determining a fourth difference between (i) the third difference and (ii) a previous value of the third difference; and selectively applying power to the fuel injector based on the third difference and the fourth difference.

14. The fuel control method of claim 13 further comprising:

determining a third sum of (i) the second sum and (ii) O previous values of the second sum, wherein O is an integer greater than or equal to one; and determining the first difference based on the third sum.

15. The fuel control method of claim 14 further comprising:

determining a fourth sum of (i) the third sum and (ii) Q previous values of the third sum, wherein Q is an integer greater than or equal to one; and determining the first difference based on the fourth sum.

16. The fuel control method of claim 15 further comprising:

determining a fifth sum of (i) the fourth sum and (ii) R previous values of the fourth sum, wherein R is an integer greater than or equal to one; and determining the first difference based on the fifth sum.

17. The fuel control method of claim 16 further comprising determining the first difference between (i) the fifth sum and (ii) a previous value of the fifth sum.

18. The fuel control method of claim 13 further comprising:

determining a minimum value of the third difference and a maximum value of the third difference; and selectively applying power to the fuel injector based on the minimum and maximum values of the third difference.

19. The fuel control method of claim 18 further comprising determining the minimum value of the third difference based on a first zero-crossing of the fourth difference.

20. The fuel control method of claim 19 further comprising determining the maximum value of the third difference based on a second zero-crossing of the fourth difference.

21. The fuel control method of claim 18 further comprising:

determining an initial pulse width to apply to the fuel injector for a fuel injection event based on a target mass of fuel;

adjusting initial pulse width based on the minimum and maximum values of the third difference to produce a final pulse width; and selectively applying power to the fuel injector for the fuel injection event based on the final pulse width.

* * * * *